US005426345A

United States Patent [19]

Madsen

[11] Patent Number: 5,426,345

[45] Date of Patent: Jun. 20, 1995

[54] HIGH VOLTAGE ELECTRONIC TUBE WITH INTERMEDIATE ELECTRODE

[75] Inventor: Jens U. Madsen, Lyngby, Denmark

[73] Assignee: Andrex Radiation Products A/S, Denmark

[21] Appl. No.: 183,379

[22] Filed: Jan. 18, 1994

[51] Int. Cl.[6] ..... H05B 37/00; H05G 1/34

[52] U.S. Cl. ..... 315/205; 378/110; 378/112

[58] Field of Search ..... 315/205, 200 R; 313/364; 378/109, 110, 121, 135, 101, 102, 105, 112; 363/59, 60, 61, 78, 100

[56] References Cited

U.S. PATENT DOCUMENTS

| | | | |
|---|---|---|---|
| 4,789,997 | 12/1988 | Madsen et al. | 378/109 |
| 5,020,087 | 5/1991 | Rix et al. | 378/134 |
| 5,335,161 | 8/1994 | Pellegrino et al. | 378/101 X |

FOREIGN PATENT DOCUMENTS

2448497C3 10/1974 Germany .

*Primary Examiner*—Ali Neyzari
*Attorney, Agent, or Firm*—Robert J. Koch

[57] ABSTRACT

A high voltage electronic tube comprises an electrode arrangement comprising an outer electrode formed by a cylindrical metal jacket, an inner electrode supported substantially centrally with respect to said outer electrode by an electrode support arranged in an insulating disc providing a vacuumtight closure for the tube and at least one intermediate electrode formed by a metal sleeve arranged concentrically between the outer and inner electrodes. From a high voltage supply circuit comprising an alternating current source and a multi stage voltage multiplier a ground potential is applied to the outer electrode and a high potential of a significant magnitude is applied to the inner electrode, whereas the intermediate electrode is connected to an intermediate stage of the voltage multiplier for receiving a potential of a magnitude between the potentials applied to the inner and outer electrodes.

8 Claims, 3 Drawing Sheets

HIGH VOLTAGE ELECTRONIC TUBE WITH INTERMEDIATE ELECTRODE

This invention relates to a high voltage electronic tube such as an X-ray tube of a concentric and mainly cylindrical construction and with an electrode arrangement comprising an outer electrode formed by a cylindrical metal jacket forming part of an outer wall of a vacuumtight housing and an inner electrode supported substantially centrally with respect to said outer electrode by an electrode support passing through a central opening in an annular insulating disc connected vacuumtight to an inner face of said jacket.

BACKGROUND OF THE INVENTION

An X-ray tube of this type is disclosed e.g. in German patent No. 2,448,497. For the supply of high voltage to the electrode arrangement of such a tube it is known e.g. from U.S. Pat. No. 4,789,997 to use a circuit arrangement comprising an alternating current source and a multi stage voltage multiplier e.g. of the Cockroft-Walton type.

For such high voltage tubes it is a general aim to improve the high voltage stability, reduce the structural volume and weight of the tube, in particular for mobile X-ray equipment and to operate the tube at increased high voltage levels.

The latter aim being as a matter of principle in conflict with the need to avoid excessive fields strengths, particularly in the region of the electrode. support, which may result in high voltage breakdown, it has been suggested to reduce this risk by incorporating an intermediate electrode formed by a metal sleeve arranged concentrically with respect to said outer and inner electrodes and dividing said annular insulating disc into two separate annular disc parts.

OBJECT OF THE INVENTION

It is the object of the invention to provide a high voltage electronic tube of the above mentioned kind, particularly for use in mobile X-ray equipment in which an improved high voltage stability is obtained with a simple and relatively inexpensive design of the high voltage supply circuit.

SUMMARY OF THE INVENTION

According to the invention a high voltage electronic tube is provided,having an electrode arrangement comprising an outer electrode formed by a cylindrical metal jacket forming part of an outer wall of a vacuumtight housing, an inner electrode supported substantially centrally with respect to said outer electrode by an electrode support passing through a central opening in an annular insulating disc connected vacuumtight to an inner face of said jacket and at least one intermediate electrode formed by a metal sleeve arranged concentrically with respect to said outer and inner electrodes and dividing said annular insulating disc into at least two separate annular disc parts, a high voltage circuit arrangement comprising an alternating current source and a multi stage voltage multiplier being connected to said outer and inner electrodes to apply an electric ground potential to said outer electrode and a high electric potential of a significant magnitude to said inner electrode, said intermediate electrode being connected to an intermediate stage of said voltage multiplier for applying to said intermediate electrode an electrical potential of a magnitude between said ground potential and said high potential.

DETAILED DESCRIPTION

Figure 1:
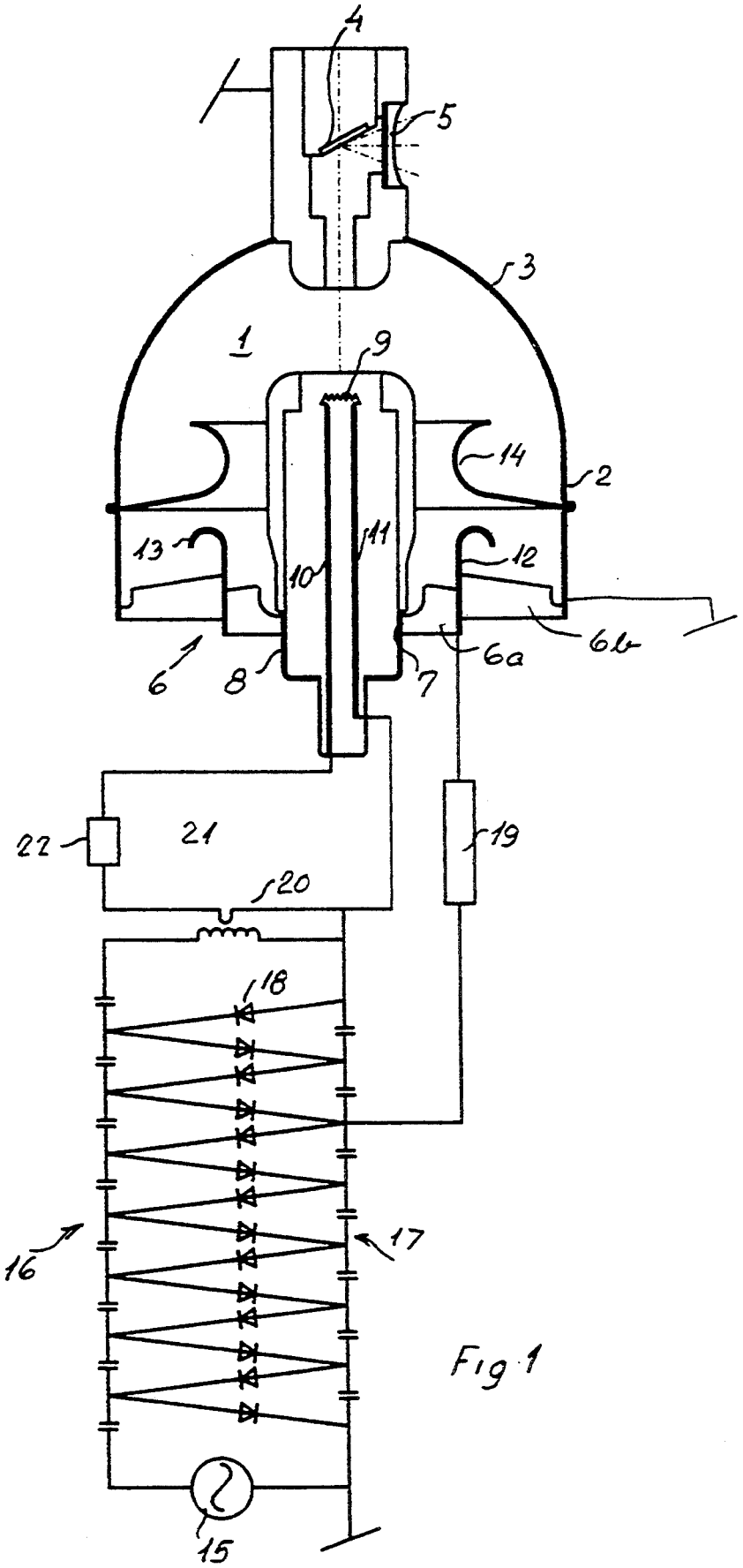
FIG. 1 is an axial sectional view of a first embodiment of a high voltage electronic tube with an associated high voltage supply circuit according to the invention.

FIG. 1 shows an X-ray tube of an essentially rotationally symmetrical construction having a vacuumized housing 1 with an outer wall including a part 2 formed by an essentially cylindrical metal jacket and joining a dome-shaped end part 3 at the top of which the anode assembly of the tube with the anode 4 and the X-ray window 5 is arranged.

At cathode side of the tube an annular insulating disc 6 which may be of ceramic material closes the housing 1 by being connected vacuumtight to the inner face of the metal jacket part 2 at the edge region thereof.

The insulating disc 6 has a central opening 7 in which an electrode support 8 of tubular configuration is arranged in vacuumtight connection with the insulating disc, e.g. by soldering, said electrode support accommodating in the embodiment shown the cathode filament 9 of the tube with associated conductors 10, 11, one of which is connected to electrode support 8.

Thus, in this embodiment the electrode arrangement at the cathode side is of a cylindrical configuration comprising filament 9 as an inner electrode and the metal jacket 2 which is conventionally grounded as an outer electrode.

In order to improve the high-voltage stability and homogenize and reduce the field strength in the region of connection between the electrode support 8 and the insulating disc 6 a mainly cylindrical metal sleeve 12 is inserted in the insulating disc 6 which is thereby divided into two separate annular disc parts **6*a* and 6*b* which are vacuumtight connected with the metal sleeve 12**, e.g. by soldering.

The metal sleeve 12 thus forms an intermediate cylindrical electrode between the inner electrode 9 and the outer electrode 2. Within the vacuumized interior of the tube 1 the metal sleeve 12 ends in a flaring funnel shaped end portion 13 which forms a shield and affects the electrical field.

Optionally, a further shield acting against secondary. electrons is formed by a flat flaring funnel shaped sleeve 14 connected with the metal jacket 2.

In stead of accommodating the cathode assembly of the tube the electrode support 8 may alternatively accommodate the anode assembly in which case the cathode assembly including filament 9 will be arranged at the tip of the dome-shaped part 3 of housing 1.

The cylindrical electrode arrangement 8, 12, 2 forms a dual cylindrical capacitor assembly and is connected to a high voltage supply circuit arrangement comprising an alternating current source 15 feeding a multi stage voltage multiplier which is preferably of the Cockroft-Walton type comprising two columns of capacitors 16, 17 connected to AC source 15, one of which is grounded, and interconnecting diodes 18.

By means of this circuit arrangement a negative potential of a significant magnitude, e.g. −100 to −450 kV, is applied to the inner electrode formed by electrode support 8 and filament 9.

According to the invention a negative potential of a magnitude between the ground potential applied to the outer electrode formed by metal jacket 2 and the significant negative potential applied to the inner electrode formed by electrode support 8 and filament 9 is applied to the intermediate electrode formed by metal sleeve 12 by connecting the latter to an intermediate stage of the voltage multiplier.

For obtaining the optimum effect of the addition of the intermediate electrode formed by metal sleeve 12 the maximum field strength in the electrode arrangement should be as low as possible. With the cylindrical capacitor geometry used for the electrode arrangement the electrical field is inversely proportional to the distance from the geometrical axis and is thus at its maximum at the surface of the electrode having the smallest radius, i.e. the inner electrode. For a two electrode system it is known that in theory the minimum value of the maximum field strength $E_{max}$ is obtained if the radius of the inner electrode is equal to that of the outer electrode divided by e, the basis for the natural logarithm.

The effect of the invention is that a further reduction of the maximum field strength can be achieved by introducing one or more additional cylindrical electrodes between the inner and outer electrodes, and it can be shown that the minimum value of $E_{max}$ will be obtained if the field strength is the same at the surfaces of the inner and intermediate electrodes.

For the simple design of a dual cylindrical capacitor geometry, i.e. with one intermediate electrode between the inner and outer electrodes as shown in FIG. 1 and for given values of the high voltage $U_t$ applied between the inner and outer electrodes, the radius $r_i$ of the inner electrode, the radius $r_m$ of the intermediate electrode and the radius $r_o$ of the outer electrode the maximum field strength $E_{max}$ can be determined by $$E_{max}=U_t/(r_i ln(r_m/r_i)+r_m ln(r_o/r_m)) \quad (1)$$

and the minimum value of $E_{max}$ will be obtained for a value of the radius $r_m$ of the intermediate electrode determined by $$r_i/r_m+ln(r_i/r_m)=ln(r_i e/r_o) \quad (2)$$

For a specific design of the electrode arrangement with $r_i$=20.5 mm and $r_o$=73.5 mm formula (2) gives the following radius for the intermediate electrode $r_m$=43.4 mm and with a total magnitude of the high voltage of −300 kV formula (1) gives for the minimum value of the maximum field strength $$E_{max}=7.85\ kV/mm$$

which can be shown to be a reduction of 31.5% relative to the minimum value of the maximum field strength obtained by the same configuration of inner and outer electrodes, but without the intermediate electrode.

The potential to be applied to the intermediate electrode from the intermediate stage of the multi stage voltage multiplier can then be determined by calculation of the voltage between the inner and intermediate electrodes for the high voltage of −300 kV to be $$U_{i\text{-}m}=120.7\ kV$$

In the embodiment in FIG. 1 a damping resistor 19 is connected between the intermediate electrode formed by sleeve 12 and the intermediate multiplier stage from which the voltage is supplied to the intermediate electrode. Moreover, as is known from the above-mentioned U.S. Pat. No. 4,789,997 the disclosure of which is incorporated herein by reference the alternating current source 15 may be frequency variable and the high voltage may be supplied to filament 9 via a transformer 20 and a filament circuit 21 including a frequency dependant impedance 22 to supply a small amplitude voltage to filament 9 obtained from a ripple voltage across a component part of the Cockroft-Walton multiplier 16 having an average potential not differing substantially from the high voltage supplied to filament 9. Thereby the entire filament circuit will be approximately on the high cathode potential and the otherwise severe demand for insulation which often requires an excessively voluminous and heavy design may be reduced.

Figure 2:
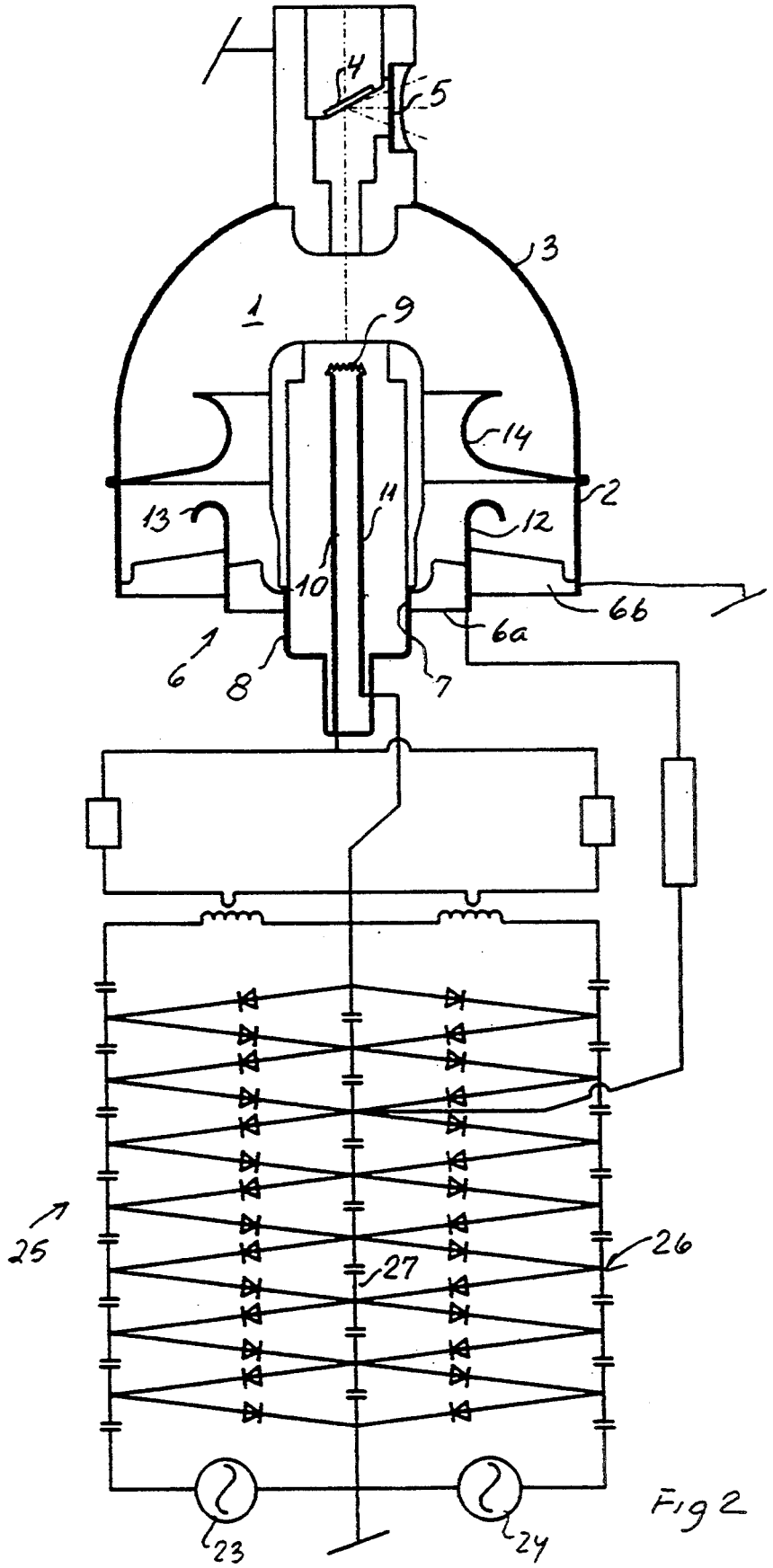
FIGS. 2 is a similar view of an alternative embodiment of a high voltage electronic tube according to the invention with a modified high voltage supply circuit.

In the alternative embodiment shown in FIG. 2 component parts of the X-ray tube corresponding to the component parts shown in FIG. 1 are designated by the same reference numerals.

In this alternative embodiment, however, the high voltage supply circuit is modified to comprise two mirror symmetrical arrangements each including an alternating current source 23, 24 and a multi stage voltage multiplier 25, 26 of the Cockroft-Walton type, whereby the multipliers 25 and 26 share a common grounded capacitor column 27. The two symmetrical arrangements must be operated in counter phase. By this modification a doubling of the current rating may be obtained.

In all other aspects the design of the X-ray tube in FIG. 2 and the high voltage supply to the intermediate electrode is the same as in the embodiment in FIG. 1.

Figure 3:
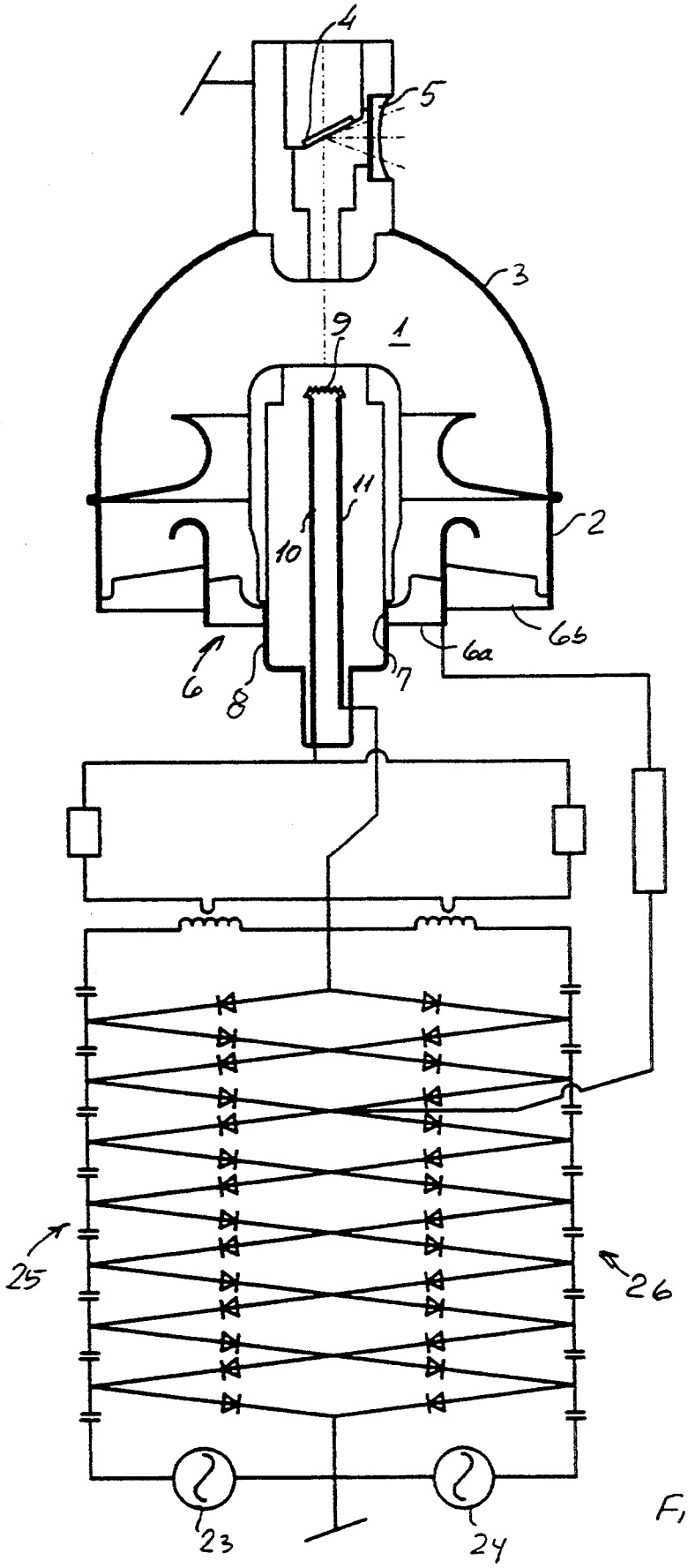
FIG. 3 is a similar view of a preferred embodiment designed as a modification of the embodiment in FIG. 2.

FIG. 3 shows a preferred embodiment corresponding in general to the embodiment in FIG. 2, but with the advantageous difference that doubling of the current rating is obtained without any additional consumption of components compared to the embodiment in FIG. 1 by leaving out the capacitors in the common grounded column in the embodiment in FIG. 2. Due to the symmetry this will have no effect on the performance of the circuit.

I claim:

1. A high voltage electronic tube having an electrode arrangement comprising an outer electrode formed by a cylindrical metal jacket forming part of an outer wall of a vacuumtight housing, an inner electrode supported substantially centrally with respect to said outer electrode by an electrode support passing through a central opening in an annular insulating disc connected vacuumtight to an inner face of said jacket and at least one intermediate electrode formed by a metal sleeve arranged concentrically with respect to said outer and inner electrodes and dividing said annular insulating disc into at least two separate annular disc parts, a high voltage circuit arrangement comprising an alternating current source and a multi stage voltage multiplier being connected to said outer and inner electrodes to apply an electric ground potential to said outer electrode and a high electric potential of a significant magnitude to said inner electrode, said intermediate electrode being connected to an intermediate stage of said voltage multiplier for applying to said intermediate electrode an electrical potential of a magnitude between said ground potential and said high potential.

2. A high voltage electronic tube as claimed in claim 1, wherein said multi stage voltage multiplier is of the Cockroft-Walton type.

3. A high voltage electronic tube as claimed in claim 2 wherein the intermediate electrode is connected to said intermediate multiplier stage at a junction in a grounded capative column of said voltage multiplier.

4. A high voltage electronic tube as claimed in claim 1, wherein said electrode arrangement constitutes the cathode assembly of said tube with said inner electrode serving as filament, the high potential applied to said inner electrode being in the range from −100 to −450 kV.

5. A high voltage electronic tube as claimed in claim 2, wherein said circuit arrangement comprises two mirror-symmetrical arrangements each including an alternating current source and a set of multiplier stages having a common grounded column, said symmetrical arrangements being operated in counter phase.

6. A high voltage electronic tube as claimed in claim 4, wherein no capacitors are incorporated in said common grounded column.

7. A high voltage electronic tube as claimed in claim 3, wherein a damping resistor is connected between said intermediate electrode and the junction at said intermediate multiplier stage.

8. A high voltage electronic tube as claimed in claim 1, wherein the alternating current source in said circuit arrangement is frequency variable and said circuit arrangement further comprises a filament circuit including a frequency dependant impedance to supply a small amplitude voltage to said inner electrode obtained from a ripple voltage across a component part of said voltage multiplier with an average potential not differing substantially from said high potential applied to the inner electrode.

* * * * *